US005940522A

United States Patent [19]

Cahill et al.

[11] Patent Number: 5,940,522

[45] Date of Patent: Aug. 17, 1999

[54] SPEAKER WITH PASSIVE VOICE COIL COOLING

[75] Inventors: David Cahill, Merrimac, Mass.; Aaron Linn, Portsmouth, N.H.; Derek Hatchett, Brookline, Mass.

[73] Assignee: Boston Acoustics, Inc., Peabody, Mass.

[21] Appl. No.: 09/076,272

[22] Filed: May 12, 1998

[51] Int. Cl.[6] ..... H04R 25/00

[52] U.S. Cl. ..... 381/397; 381/412; 381/396

[58] Field of Search ..... 381/396, 397, 381/407, 412, 420, FOR 152, FOR 159, FOR 154

[56] References Cited

U.S. PATENT DOCUMENTS

| | | | |
|---|---|---|---|
| 4,590,332 | 5/1986 | Delbuck | 179/115.5 |
| 4,757,547 | 7/1988 | Danley | 381/397 |
| 5,357,586 | 10/1994 | Nordschow et al. | 381/397 |

*Primary Examiner*—Huyen Le

*Attorney, Agent, or Firm*—Wolf, Greenfield & Sacks, P.C.

[57] ABSTRACT

An audio speaker, the voice coil of which is passively cooled by using at least one of the speaker cone and spider as a bellows to draw air in and to push air out through a first vent passing through the voice coil and a second vent, connected to the first vent through an air flow path, which second vent is formed in a basket of the speaker which is formed of a material having good heat transfer properties. Air drawn into the speaker through the first vent removes heat from the voice coil and is heated thereby. This air is mixed with cooler air drawn in through the second vent which cooler air is expelled through both vents under appropriate action of the bellows. Partially cooled air expelled through the first vent further cools the voice coil and expelled through the second vent, which is also partially heated, has heat removed therefrom as it passes through the second vent formed in the basket, the relatively large area of the basket passed through by this air functioning as a heat sink. Turbulence in the vents assures air exchange at the entrances to the vents and the drawing of replacement air therein.

5 Claims, 2 Drawing Sheets

SPEAKER WITH PASSIVE VOICE COIL COOLING

FIELD OF THE INVENTION

This invention relates to audio speakers and more particularly, to a compact and efficient mechanism for providing voice coil cooling in such a speaker.

BACKGROUND OF THE INVENTION

The current trend in audio speaker in general, and in audio speakers utilized in automobiles in particular, is to make the speakers increasingly powerful while keeping their size to a minimum. The more powerful the speaker, the more current flows through the voice coil of the speaker, and therefore the more heating there is of the voice coil. However, minimizing the size of the speaker significantly limits the ability to use conventional heat sink techniques with such speakers. Further, because of thc limited energy available in an automobile, it is desirable that heat removal/heat sinking from a speaker coil be passive rather than active (i.e., that it not require the use of an extra energy-consuming device such as a fan or blower).

While many techniques have been used for removing heat from voice coils, and many additional techniques have been proposed, most of these techniques involve either active cooling through use of a fan or the like and/or the use of additional space-consuming hardware in the form of a vented heat sink or the like. A need therefore exists for a simple and relatively inexpensive technique for removing heat from the voice coil of a speaker, particularly a high performance speaker, and more specifically one adapted for automotive use, which technique does not require either the use of an active cooling component or the use of an extra piece of heat dissipation hardware, but instead requires only the use of components normally existing in such a speaker.

SUMMARY OF THE INVENTION

In accordance with the above, this invention provides a speaker of a type having a speaker cone mounted to a basket formed of a material having good heat transfer properties. The speaker cone is driven by a voice coil which may be mounted on a voice coil follower supported on a spider which may also be driven by the voice coil. A first vent is provided which extends from the rear side of the speaker (i.e., the side opposite the cone), through substantially the center of the speaker and of the voice coil; a circumferential second vent is formed through the basket and also extends from the rear side of the speaker; and a circumferential air flow path extends from the first vent to the second vent. The two vents and the circumferential air flow path are positioned, interconnected and designed to facilitate air being moved in selected directions therethrough in response to movement of the speaker cone and/or the spider so as to remove heat from the voice coil and to dissipate the heat, at least in part, in the material of the basket. The first vent may also pass through the voice coil follower, and the circumferential air flow path may include a plurality of circumferentially spaced openings in the voice coil follower. Filters may be provided in at least one of said vents, and preferable in both vents, to prevent dust and other particulate matter from entering the speaker.

The foregoing and other objects, features, and advantages of the invention will be apparent from the following more particular description of a preferred embodiment of the invention as illustrated in the accompanying drawings.

IN THE DRAWINGS

FIGS. 1 and 2 are a cutaway prospective view and a cutaway side view, respectively, of a speaker in accordance with the teachings of this invention.

DETAILED DESCRIPTION

Figure 1:
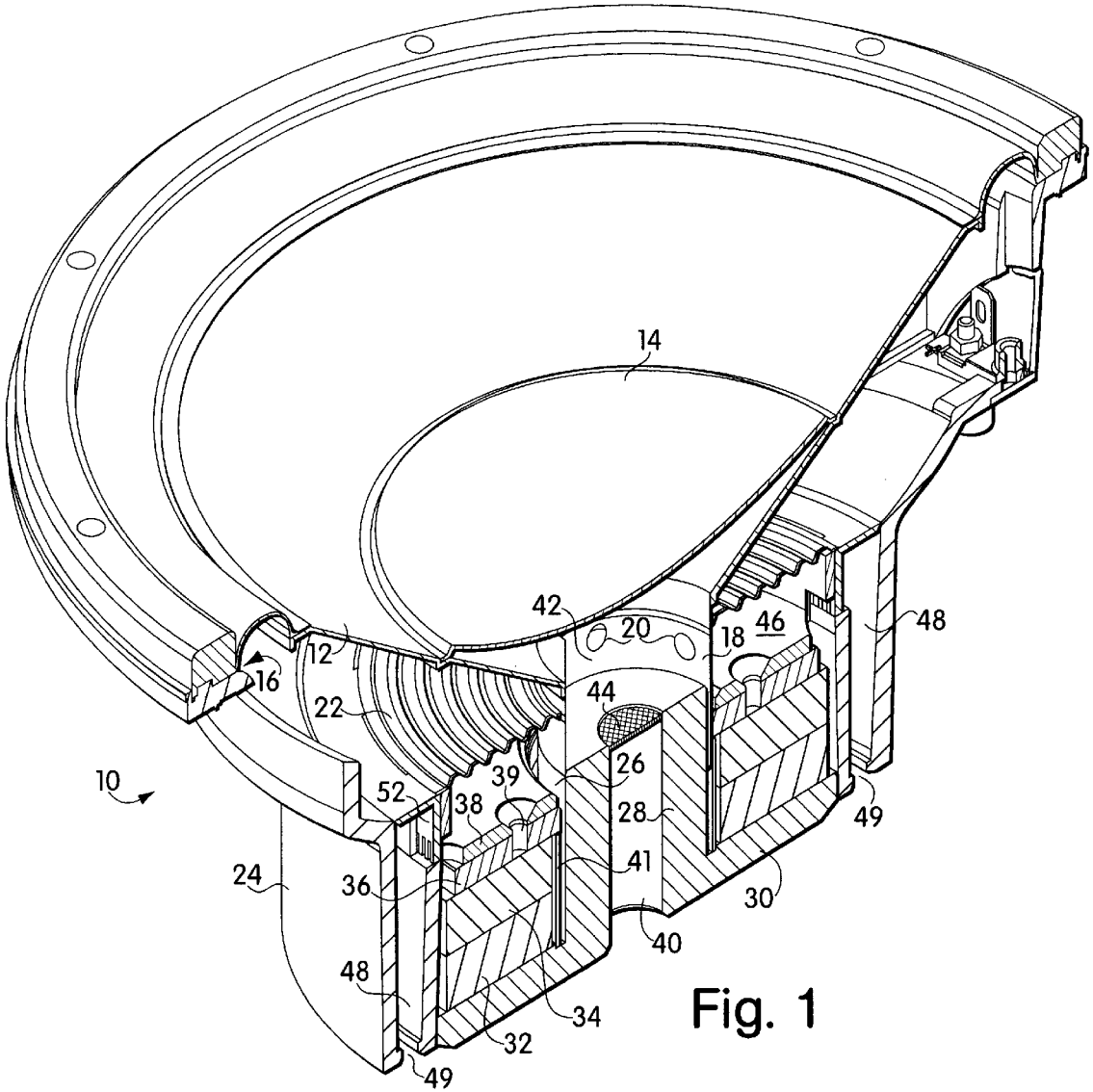
Figure 2:
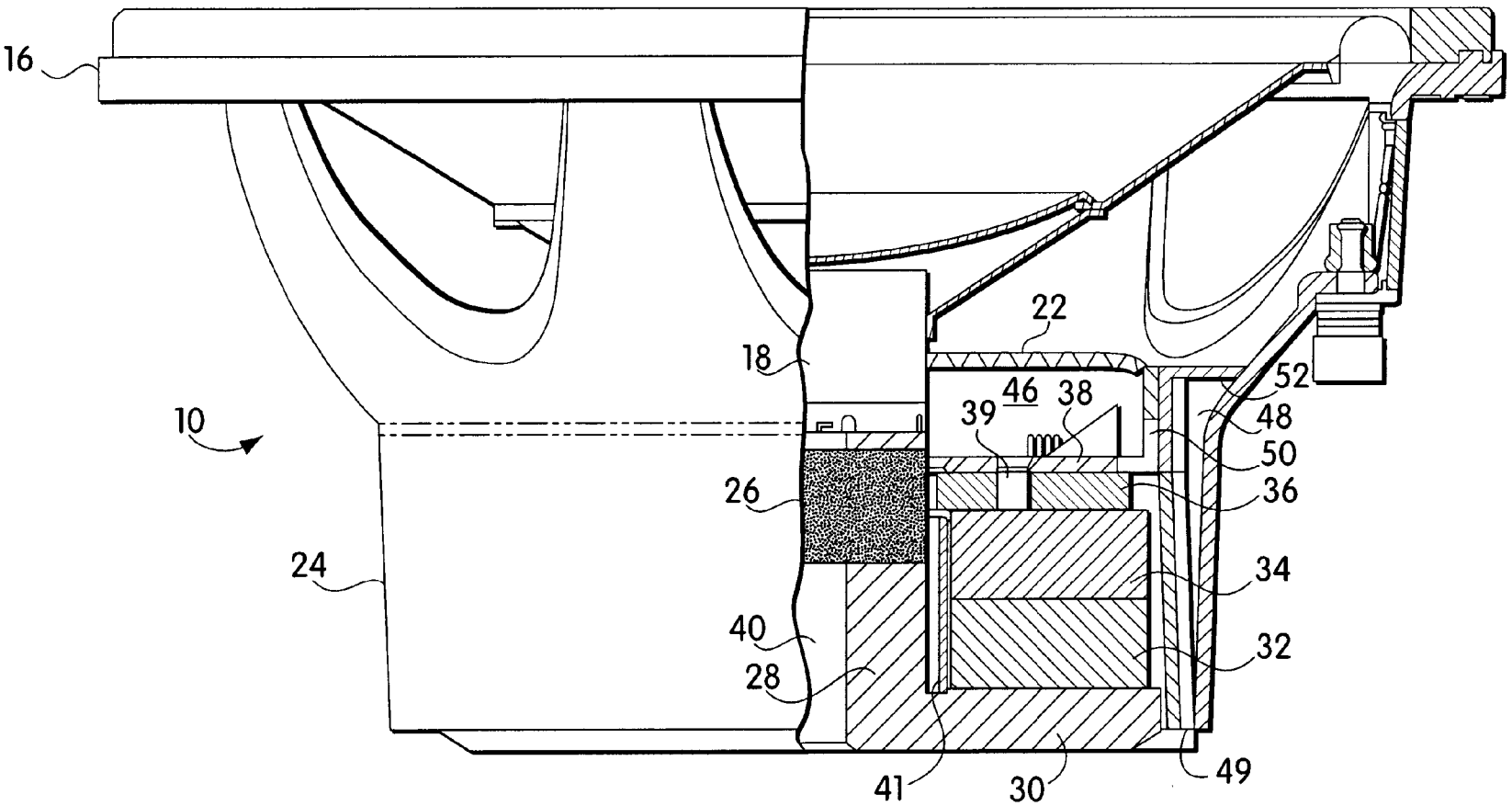

Referring to the figures, speaker 10 has a diaphragm 12 with a dust cap 14 mounted at its center. Diaphragm 12 is attached at its outer end to basket 24 in standard fashion by a rim assembly 16, and is attached at its inner end to a voice coil former 18 having a plurality of circumferential holes 20 formed therein. Voice coil former 18 is supported on a flexible spider 22 attached at its inner side to the voice coil former and on its outer side in standard fashion to speaker basket 24. Voice coil 26 is wrapped around voice coil former 18. Voice coil former 18 is mounted over a cylindrical center portion 28 of base plate 30, which plate is formed of steel or other material, preferably ferrous material, having high magnetic permanence. A pair of high performance magnets 32 and 34 are stacked on top of plate 30 with a high magnetic permanence top plate 36 being mounted about the magnets. Plate 30, magnets 32 and 34 and plate 36 are secured together with a suitable adhesive and are secured in basket 24 by screwing plate 36 to flange 38 which is part of basket 24 with screws (not shown) extending through holes 39. Cylindrical portion 28 extends through each of the elements 32, 34, 36, and 38. An aluminum ring 41 is provided between magnets 32, 34 and projection 28 to lower distortion and provide an enhanced heat path to the projection.

The speaker described to this point is a conventional speaker, and the particular configuration shown in the drawings is for illustrational purposes only. The only portions of the design described so far which are not conventional is cylindrical projection 28 and aluminum ring 41. One problem with the speaker described to this point is that, in order to achieve high performance from the speaker, increasing currents are applied to the voice coil resulting in heating thereof. If this heat is not removed, it can burn out the voice coil requiring either costly repair of the speaker or the disposal thereof. As indicated earlier, an effective passive cooling for the speaker which does not require the addition of components such as heat sinks to the speaker, and thus holds down both the size and cost of the speaker, does not currently exist.

In accordance with the teachings of this invention, the above objectives are achieved by providing a vent 40 which extends from the rear of plate 30, which is also the rear of speaker 10, through substantially the center of cylindrical portion 28 of the backplate to a chamber 42 formed inside voice coil former 18. Chamber 42 is bounded on one side by the top of cylindrical section 28 and on the other side by dust cap 14. A screen or filter 44 is provided at the inner end of vent 40 to prevent dust or other particulate matter from entering the speaker through the vent. Chamber 42 is connected to a circumferential chamber 46 by holes 20, chamber 46 being circumferentially defined by the outer wall of voice coil former 18 and the inner wall of basket 24, and being defined on the bottom by the top of flange 38 and on top by the underside of spider 22. A circumferential vent 48 is formed in basket 24, which vent opens to the rear of the speaker through a plurality of slots 49, the strips (not shown) separating the slots 49 providing improved structural integrity for the basket. Chamber 46 connects to vent 48 through slits 50 in the inner wall of the basket and a filter screen 52, which also functions to keep dust and other particulate matter out of the speaker. Screen 52 may be a toothed plastic or metal plate as shown, may be a screen of metal or other suitable material or may be of some other suitable form.

In operation changes in electrical signal applied to voice coil 26 cause the coil to interact with magnets 32 and 34 to move voice coil former 18 up and down. This results in a corresponding movement of the diaphragm 12 and of spider 22, both of which are connected at one end to voice coil former 18. As spider 22 moves up under the influence of voice coil former 18. the size of chamber 46 is increased, causing air to be drawn into this chamber through vents 40 and 48, replacement air drawn through vent 40 passing through the inner side of coil 26 and, through chamber 42 and holes 20, to chamber 46. The air passing through vent 40 is heated by the coil as it passes therethrough and serves to remove heat from the coil. Heat is also removed from projection 28 which also functions as a heat sink for the voice coil. This heat is somewhat dissipated over the larger areas of chambers 42 and 46 and the heated air is cooled by mixing with the air drawn in through vent 48. Further, when spider 22 is moved down by voice coil former 18, reducing the size of chamber 46, much of the air forced out of this chamber is forced out through circumferential opening 50 into vent 48. This heated air comes in contact with the large aluminum vent surface of basket 24, which surface functions as a heat sink to remove heat from the air. Since the basket has a large surface in contact with external air, heat absorbed by the basket can be dissipated to surrounding ambient air by both radiation and convection. The air flowing back through vent 40 has also been somewhat mixed and cooled in chamber 46 and therefore also removes some heat from coil 26 and projection 28 on the way out. Turbulence in the air flow at the vents also results in heated air leaving the vents and outside replacement air being drawn in, further facilitating the cooling process.

Thus, this invention utilizes the movement of the speaker cone and/or in particular, the movement of spider 12 (spider 12 being used for the disclosed preferred embodiment) as a bellows to draw air over voice coil 26 to facilitate the removal of heat therefrom and to pump the heated air over a large area of basket 24 to remove heat from the air. The folded basket construction provided by the vent 48 provides essentially twice as much heat sink for the same basket size. The speaker thus does not require an external fan, blower or other power dissipating component in order to achieve the desired cooling effect. Further, since the large surface areas of the speaker basket are utilized to perform the heat sink function, additional heat sink components are not required. A relatively simple and inexpensive mechanism is thus provided for cooling the voice coil which does not in any way increase the power or space requirements for the speaker.

While the invention has been particularly shown and described above with reference to a preferred embodiment illustrated in the figures, it is apparent that the teachings of this invention could be utilized with other speaker designs, so long as the speaker design is such that a vent may be provided through which air can be passed over the voice coil when drawn into and/or pushed out, the speaker as a result of diaphragm and/or spider movement, and either a single circumferential vent or a plurality of circumferentially arranged vents can be provided in the basket through which air may pass when drawn into or pushed from the speaker. Thus, while the invention has been particularly shown and described above with reference to a preferred embodiment, the foregoing and other changes in forming detail may be made therein by one skilled in the art, while still remaining within the spirit and scope of the invention which is to be defined only by the following claims.

What is claimed is:

1. A speaker having a speaker cone supported on a basket formed of a material having good heat transfer properties, the speaker cone being driven by a voice coil supported by a spider, characterized by the inclusion of a first vent extending from a rear side of the speaker opposite said cone through substantially a center of the speaker and of said voice coil, a circumferential second vent formed through said basket, and extending from said rear side of the speaker, and a circumferential air flow path extending from said first vent to said second vent, said first and second vents and said circumferential air flow path being positioned, interconnected and designed to facilitate air being moved therethrough in response to movement of at least one of said speaker cone and said spider so as to remove heat from said voice coil and to dissipate said heat at least in part in said basket.

2. A speaker as claimed in claim 1 wherein said voice coil is mounted on a voice coil former, wherein said first vent passes through said voice coil former, and wherein said circumferential air flow path includes a plurality of circumferentially spaced openings in said voice coil former.

3. A speaker as claimed in claim 1 wherein said air flow path includes a chamber in which heated air drawn into said speaker through said first vent and cooler outside air drawing in through said second vent mix so that the temperature of air in said chamber is lower than that of air entering the chamber from said first vent.

4. A speaker as claimed in claim 1 including a filter in at least one of said vents which prevent particulate matter from entering the speaker through the vent.

5. A speaker as claimed in claim 4 wherein there is a said filter in both said first and second vents.

* * * * *